US009245732B2

(12) United States Patent
Kim et al.

(10) Patent No.: US 9,245,732 B2
(45) Date of Patent: Jan. 26, 2016

(54) LIGHTING APPARATUS

(71) Applicant: LG ELECTRONICS INC., Seoul (KR)

(72) Inventors: Junsung Kim, Seoul (KR); Hyunjung Kim, Seoul (KR); Donghun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 74 days.

(21) Appl. No.: 14/075,867

(22) Filed: Nov. 8, 2013

(65) Prior Publication Data

US 2014/0132153 A1 May 15, 2014

(30) Foreign Application Priority Data

Nov. 12, 2012 (KR) ..... 10-2012-0127117

(51) Int. Cl.
*H01J 25/50* (2006.01)
*H01J 65/04* (2006.01)
*H01J 7/46* (2006.01)

(52) U.S. Cl.
CPC ..... *H01J 65/044* (2013.01); *H01J 7/46* (2013.01); *H01J 25/50* (2013.01)

(58) Field of Classification Search
CPC ..... H01J 23/18; H01J 23/22; H01J 25/00; H01J 25/50; H01J 65/04
USPC ..... 315/39, 39.51, 248, 267, 344
See application file for complete search history.

(56) References Cited

U.S. PATENT DOCUMENTS

| | | | | |
|---|---|---|---|---|
| 4,060,778 | A | 11/1977 | Hefni et al. | |
| 5,227,698 | A | 7/1993 | Simpson et al. | |
| 5,910,710 | A * | 6/1999 | Simpson | 315/248 |
| 5,977,712 | A * | 11/1999 | Simpson | 315/39 |
| 6,046,545 | A * | 4/2000 | Horiuchi et al. | 315/39 |
| 6,476,557 | B1 * | 11/2002 | Leng et al. | 313/637 |
| 6,774,571 | B2 * | 8/2004 | Choi et al. | 315/112 |
| 2002/0043937 | A1 * | 4/2002 | Ogura | H01J 23/005 315/39.51 |
| 2004/0239261 | A1 | 12/2004 | Kim et al. | |

FOREIGN PATENT DOCUMENTS

GB 2 388 717 A 11/2003

* cited by examiner

*Primary Examiner* — Tung X Le
(74) *Attorney, Agent, or Firm* — Birch, Stewart, Kolasch & Birch, LLP

(57) ABSTRACT

A lighting apparatus is provided that includes a magnetron configured to generate microwaves having a predetermined frequency, a waveguide including a first wave guide space configured to introduce and guide the microwaves and a second wave guide space expanded from the first wave guide space, a resonator to which the microwaves are transmitted from the waveguide and a bulb located in the resonator, the bulb encapsulating a light emitting material and being configured to emit light in response to the transmitted microwaves. The second wave guide space is located in a transmission path of the microwaves transmitted from the magnetron to the resonator.

14 Claims, 5 Drawing Sheets

LIGHTING APPARATUS

This application claims the benefit of Korean Patent Application No. 10-2012-0127117, filed on Nov. 12, 2012, which is hereby incorporated by reference as if fully set forth herein.

BACKGROUND OF THE INVENTION

1. Field of the Invention

The present invention relates to a lighting apparatus and, more particularly, to a lighting apparatus which emits light using microwave source energy.

2. Discussion of the Related Art

Generally, a microwave discharge lamp is an apparatus that applies microwaves to an electrode-less plasma bulb to generate visible light using microwaves at frequencies of hundreds of MHz to several GHz. The microwave discharge lamp has greater brightness and efficiency than an incandescent lamp and a fluorescent lamp, and is increasingly used. An electrode-less discharge lamp is a type of microwave discharge lamp that uses an inactive gas encapsulated in an electrode-less quartz globe (bulb). Almost all modern microwave discharge lamps are configured to emit a continuous spectrum of visible light through high pressure sulfur discharge.

A related art microwave discharge lamp includes a magnetron configured to generate microwaves, a bulb encapsulating a light emitting material to generate light using the microwaves, a resonator for resonation of the microwaves, in which the bulb is located, and a waveguide connecting the magnetron and the resonator to each other.

The light emission principle of the microwave discharge lamp will now be described in brief Microwaves generated in the magnetron are transmitted to the resonator through the waveguide and, in turn, the microwaves introduced into the resonator excite the light emitting material in the bulb via resonation thereof within the resonator. As the light emitting material filling the bulb is converted into plasma, light is generated and emitted outwardly from the resonator.

The bulb and the magnetron are non-linear, and the microwaves generated in the magnetron include harmonics, in addition to a design frequency. Certain harmonics reduce lamp lifespan and magnetron efficacy, and may cause communication malfunctions. Accordingly, a structure for removal of certain harmonics generated by the microwave discharge lamp is desired.

SUMMARY OF THE INVENTION

Accordingly, the present invention is directed to a lighting apparatus that substantially obviates one or more problems due to limitations and disadvantages of the related art.

An object of the present invention is to provide a lighting apparatus, which may enhance luminous efficacy and increase lifespan of a magnetron.

Another object of the present invention is to provide a lighting apparatus, which may achieve improved EMI.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a lighting apparatus includes a magnetron configured to generate microwaves having a predetermined frequency, a waveguide including a first wave guide space for introduction and guidance of the microwaves and a second wave guide space expanded from the first wave guide space in order to remove even harmonics of the microwaves transmitted through the first wave guide space, a resonator to which the microwaves are transmitted from the waveguide, and a bulb received within the resonator, the bulb encapsulating a light emitting material, wherein the second wave guide space is located in a transmission path of the microwaves that move from the first wave guide space to the resonator.

Odd harmonics of the microwaves, transmitted through the first wave guide space, may be reflected from the second wave guide space to the resonator, and the even harmonics of the microwaves, transmitted through the first wave guide space, may be introduced into and grounded in the second wave guide space.

The second wave guide space may be expanded from the first wave guide space so as to have a length of 0.25 times a wavelength of the microwaves.

The first wave guide space and the second wave guide space may have the same length.

The first wave guide space and the second wave guide space may have the same characteristic impedance.

The second wave guide space may extend perpendicular to a longitudinal direction of the first wave guide space.

The second wave guide space may extend far away from the bulb.

The second wave guide space may extend from a particular region of the first wave guide space between the magnetron and the bulb.

The microwaves, to be transmitted to the resonator through the first wave guide space, may pass through the second wave guide space, and thereafter only the odd harmonics of the microwaves may be transmitted to the resonator.

The second wave guide space may extend parallel to a longitudinal direction of the first wave guide space.

A width of the second wave guide space may be less than a longitudinal length of the second wave guide space.

A dielectric substance may be inserted into the second wave guide space.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Figure 1:
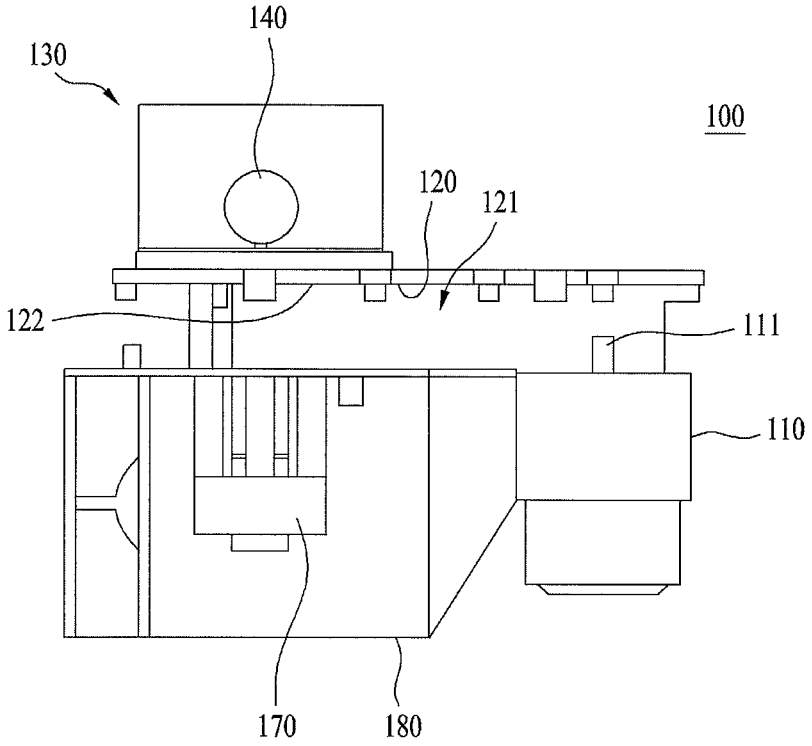
FIG. 1 is a plan view showing the interior of a lighting apparatus according to an embodiment of the present invention.

Hereinafter, a lighting apparatus according to embodiments of the present invention will be described in detail with reference to the accompanying drawings. The accompanying drawings show non-limiting examples of various configurations of the present invention and are provided for more detailed explanation of the present invention; however the technical spirit of the present invention is not limited thereto.

In addition, the same or similar elements are denoted by the same reference numerals even though they are depicted in different drawings, and a repeated description thereof will be omitted. In the drawings, for convenience of explanation, sizes and shapes of respective constituent members may be enlarged or reduced.

While the terms first, second, etc. may be used herein to describe various components, these components are not limited by these terms. These terms are used simply to discriminate any one component from other components.

FIG. 1 is a plan view showing the interior of a lighting apparatus according to an embodiment of the present invention.

The lighting apparatus 100 according to an embodiment of the present invention is adapted to emit light using microwaves and, thus, may be referred to as a microwave discharge lamp.

Referring to FIG. 1, the lighting apparatus 100 includes a magnetron 110 configured to generate microwaves, a waveguide 120 which includes a wave guide space 121 for introduction and guidance of the microwaves and an aperture 122 for discharge of the microwaves, a resonator 130 to which the microwaves are transmitted through the aperture 122, and a bulb 140 which is received within the resonator 130 and encapsulating a light emitting material. Hereinafter, the respective components of the lighting apparatus 100 will be described in detail with reference to the accompanying drawings.

The magnetron 110 generates microwaves of a predetermined frequency and a high voltage generator may be integrated with, or be separately formed from, the magnetron 110. The high voltage generator generates a high voltage and the magnetron 110 generates high frequency microwaves upon receiving the high voltage generated by the high voltage generator.

The waveguide 120 includes the wave guide space 121 for guidance of the microwaves generated by the magnetron 110 and the aperture 122 for transmission of the microwaves to the resonator 130. An antenna 111 of the magnetron 110 is inserted into the wave guide space 121. The microwaves are guided along the wave guide space 121 and are, thereafter, discharged into the resonator 130 through the aperture 122.

The resonator 130 functions to shield outward discharge of the microwaves introduced therein to create a resonance mode and to generate a strong electric field via excitation of the microwaves. The resonator 130 may have a mesh shape.

The bulb 140, which is filled with the light emitting material, is located within the resonator 130. The bulb 140 may have a rotating shaft mounted to a motor 170. In addition, in FIG. 1, the lighting apparatus 100 includes a housing 180 surrounding the motor 170.

The light emission principle of the lighting apparatus 100 of a microwave discharge lamp will now be briefly described. Microwaves generated in the magnetron 110 are transmitted to the resonator 130 through the wave guide space 121 of the waveguide 120 and, in turn, the microwaves introduced into the resonator 130 excite the light emitting material in the bulb 140 via resonation thereof within the resonator 130. As the light emitting material filling the bulb 140 is converted into plasma, light is generated and emitted outwardly from the resonator 130. Here, the light emitting material may be constituted of one or more selected from a group consisting of sulfur, calcium bromide ($CaBr_2$), lithium iodide (LiI), and indium bromide (InBr).

The lighting apparatus 100 according to an embodiment of the present invention includes the magnetron 110 configured to generate microwaves having a predetermined frequency (f).

Figure 2:
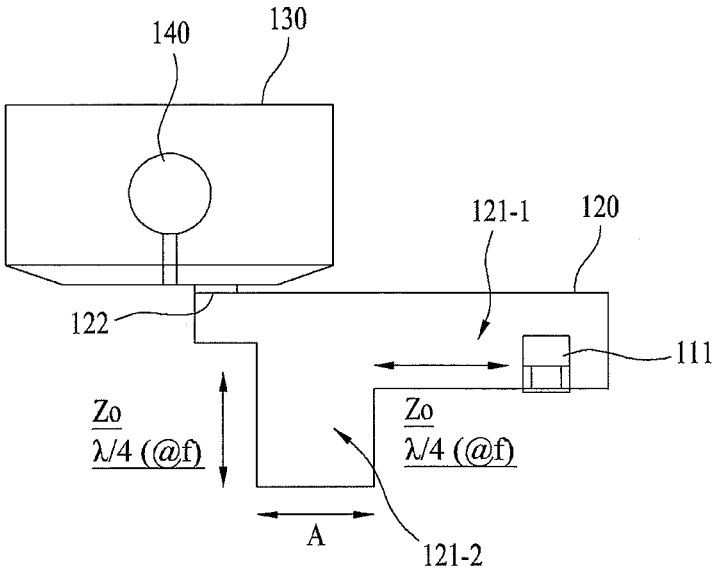
FIG. 2 is a conceptual view showing a waveguide included in the lighting apparatus according to an embodiment of the present invention.

As shown in FIG. 2, the waveguide 120 of the lighting apparatus 100 includes a first wave guide space 121-1 for introduction and guidance of the microwaves and a second wave guide space 121-2 expanded from the first wave guide space 121-1 in order to remove even harmonics M2 of the microwaves transmitted through the first wave guide space 121-1. In this embodiment, the second wave guide space 121-2 is located in a transmission path of the microwaves that move along the first wave guide space 121-1 to the resonator 130. The first wave guide space 121-1 and the second wave guide space 121-2 define the aforementioned wave guide space 121 of the waveguide 120.

The first wave guide space 121-1 may be defined as a space from a region for insertion of the antenna 111 of the magnetron 110 to a region provided with the aperture 122 for transmission of the generated microwaves into the resonator 130. The second wave guide space 121-2 may be defined as a space expanded from the first wave guide space 121-1.

In the microwave lighting apparatus 100, the microwaves generated by the magnetron 110 contain harmonics in addition to a design frequency. These harmonics are due to nonlinear characteristics of the bulb 140 and the magnetron 110. Certain harmonics reduce lifespan of the lighting apparatus 100 and magnetron efficacy and also have a negative effect on communication and frequency bands.

The harmonics may be determined by the following Equation 1.

$$\text{Harmonics}=\text{Design Oscillation Frequency}\times N\times\text{Design Frequency } (N=2, 3, 4) \qquad \text{Equation 1}$$

Generally as N increases, the magnitude of the harmonics decreases. However, if N is 2, harmonics are sufficiently great and it is preferable to limit the harmonics or to remove the harmonics entirely. More specifically, microwaves having a predetermined frequency (f) generate odd harmonics and even harmonics. Among these harmonics, the even harmonics reduce lifespan of the lighting apparatus 100 and magnetron efficacy and have a negative effect on communication and frequency bands. Accordingly, with regard to the above-described even harmonics, it is preferable to prevent or limit generation of the even harmonics. Moreover, even if the even harmonics are generated, it is preferable to limit or remove the even harmonics entirely in order to prevent the even harmonics from being transmitted into the resonator 130.

For the foregoing reason, the waveguide 120 constituting the lighting apparatus 100 according to an embodiment of the present invention includes the first wave guide space 121-1 for introduction and guidance of the microwaves and the second wave guide space 121-2 expanded from the first wave guide space 121-1 in order to remove the even harmonics M2 of the microwaves transmitted through the first wave guide space 121-1. That is, the lighting apparatus 100 according to an embodiment of the present invention is adapted to remove the even harmonics M2 resulting from the mechanical structure of the waveguide 120.

Figure 3:
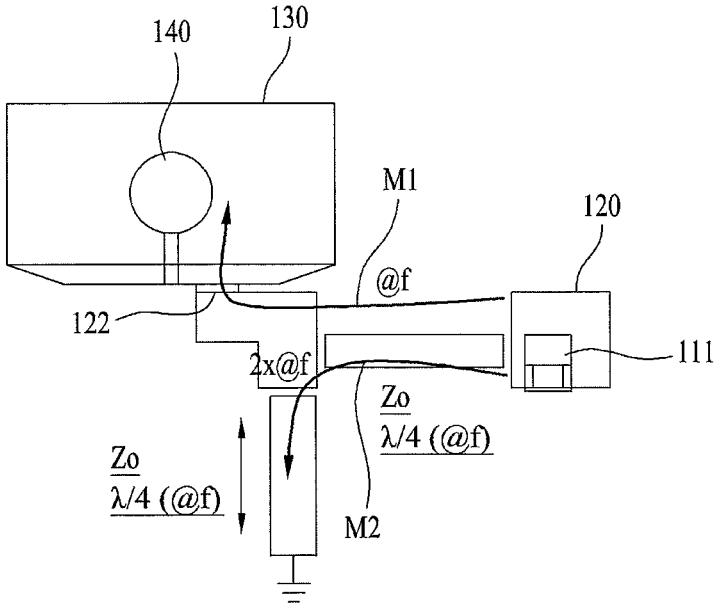
FIG. 3 is a conceptual view showing an operation mode of the lighting apparatus according to an embodiment of the present invention.

Next, FIG. 3 is an equivalent circuit diagram of the waveguide 120 exemplarily shown in FIG. 2. Referring to FIGS. 2 and 3, odd harmonics M1 of the microwaves, transmitted through the first wave guide space 121-1, are reflected from the second wave guide space 121-2 to the resonator 130. The even harmonics M2 of the microwaves transmitted through the first wave guide space 121-1 are introduced into and grounded in the second wave guide space 121-2. That is, the second wave guide space 121-2 expanded from the first wave guide space 121-1 removes the above-described even harmonics M2.

In this embodiment, a cut-off frequency of the waveguide 120 is associated with a length of the wave guide space 121, and the second wave guide space 121-2 is expanded from the first wave guide space 121-1 so as to have a length of 0.25 times a wavelength λ (λ/4) thus serving to remove the even harmonics M2 of the microwaves. In addition, a length of the second wave guide space 121-2 may be experimentally determined according to frequency characteristics of the microwaves.

The first wave guide space 121-1 and the second wave guide space 121-2 may have the same length so that, if the first wave guide space 121-1 has a length of λ/4, then the second wave guide space 121-2 has a length of λ/4. In the embodiment shown, the first wave guide space 121-1 has a length of λ/4 and the second wave guide space 121-2 extends from a distal end of the first wave guide space 121-1 by a length of λ/4.

A dielectric substance may be inserted into the second wave guide space 121-2. In this situation, the second wave guide space 121-2 may extend by a length less than 0.25 times a wavelength λ of the microwaves due to the presence of the dielectric substance.

A width of the second wave guide space 121-2 may be less than a longitudinal length of the second wave guide space 121-2. More specifically, if the second wave guide space 121-2 has a length of λ/4, a width (A) of the second wave guide space 121-2 may be less than λ/4. Because a cut-off frequency of the waveguide 120 is associated with a length of the wave guide space 121 as described above, the microwaves may act as if a width of the second wave guide space 121-2 is a length of the second wave guide space 121-2 if the width of the second wave guide space 121-2 is greater than the length of the second wave guide space 121-2, which may make it difficult to achieve desired effects.

In an embodiment, in the case of a WR340 waveguide, a width of the second wave guide space 121-2 must be less than 43.2 mm.

The second wave guide space 121-2 may extend perpendicular to a longitudinal direction of the first wave guide space 121-1. In addition, the second wave guide space 121-2 may extend away from the bulb 140. Referring to FIG. 1, the second wave guide space 121-2 is located near the motor 170 inside the housing 180.

The first wave guide space 121-1 and the second wave guide space 121-2 may be configured to maintain the same characteristic impedance Zo.

Figure 4:
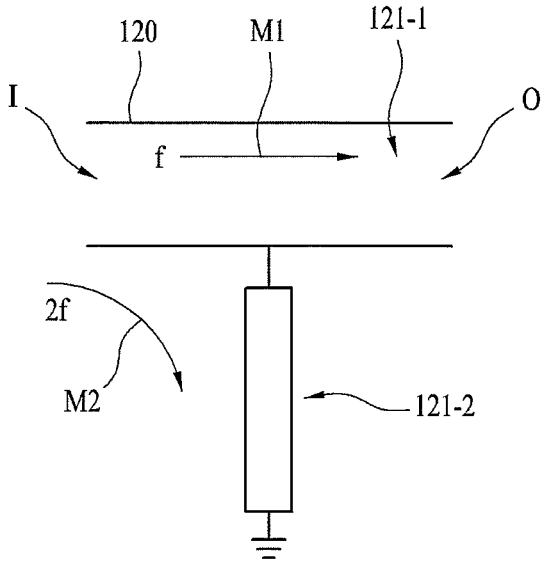
FIG. 4 is a conceptual view showing an operation mode of the lighting apparatus according to an embodiment of the present invention.
Figure 5:
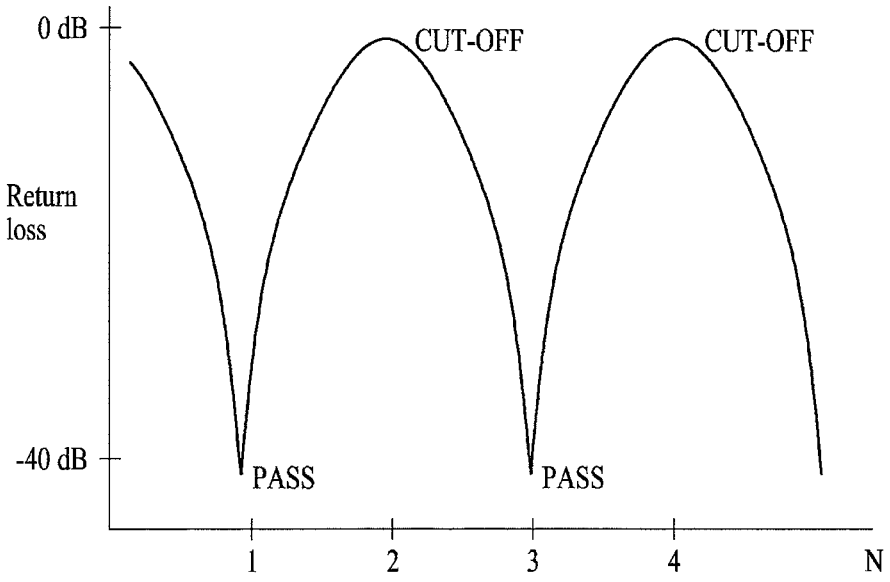
FIG. 5 is a graph showing an operation mode of the lighting apparatus according to an embodiment of the present invention.

Referring to FIGS. 4 and 5, when the second wave guide space 121-2 is expanded from the first wave guide space 121-1, an odd/even band pass filter may be formed in the waveguide 120. That is, the second wave guide space 121-2 may function as a filter. FIG. 5 is a graph showing the situation in which microwaves pass through the second wave guide space 121-2 or are cut off by the second wave guide space 121-2 according to the magnitude of N that determines the degree of harmonics. Reference character 1 denotes an entrance of the waveguide 120, and reference character O denotes an exit of the waveguide 120 (See FIG. 4).

In this embodiment, the odd harmonics M1 of the microwaves transmitted through the first wave guide space 121-1 are not cut off by the second wave guide space 121-2, but pass through the second wave guide space 121-2 to thereby be transmitted to the resonator 130. On the other hand, the even harmonics M2 of the microwaves are introduced into and grounded in the second wave guide space 121-2.

In addition, in order for the second wave guide space 121-2 to function as a filter as described above, a length of the second wave guide space 121-2 is important, and thus the second wave guide space 121-2 may be expanded from the first wave guide space 121-1 so as to have a length of 0.25 times a wavelength λ of the microwaves, thus serving to remove the even harmonics M2 of the microwaves.

Figure 6:
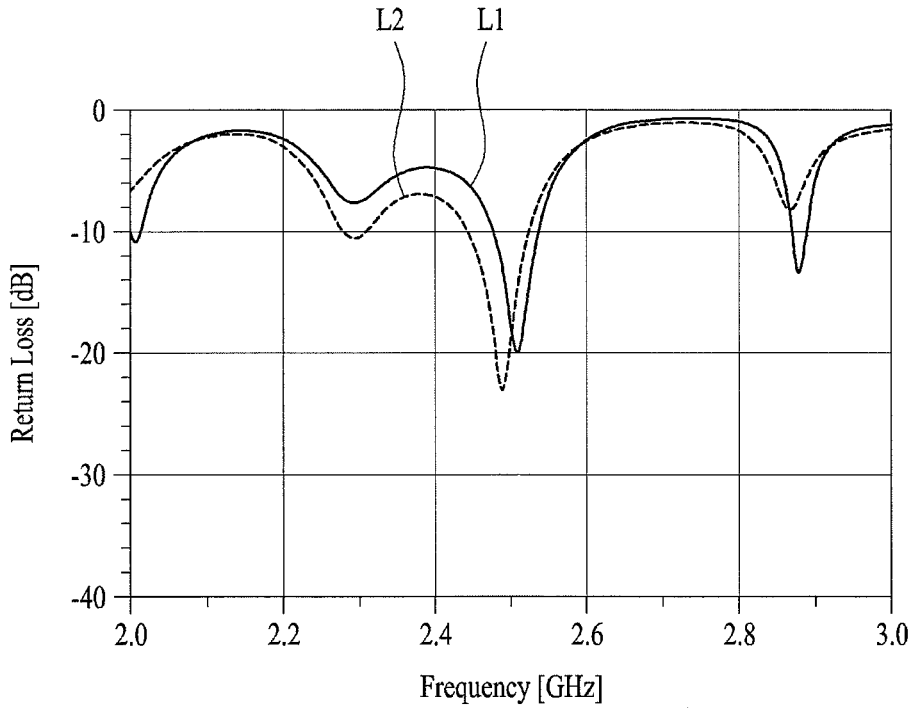
FIGS. 6 and 7 are graphs showing effects of the lighting apparatus according to an embodiment of the present invention.
Figure 7:
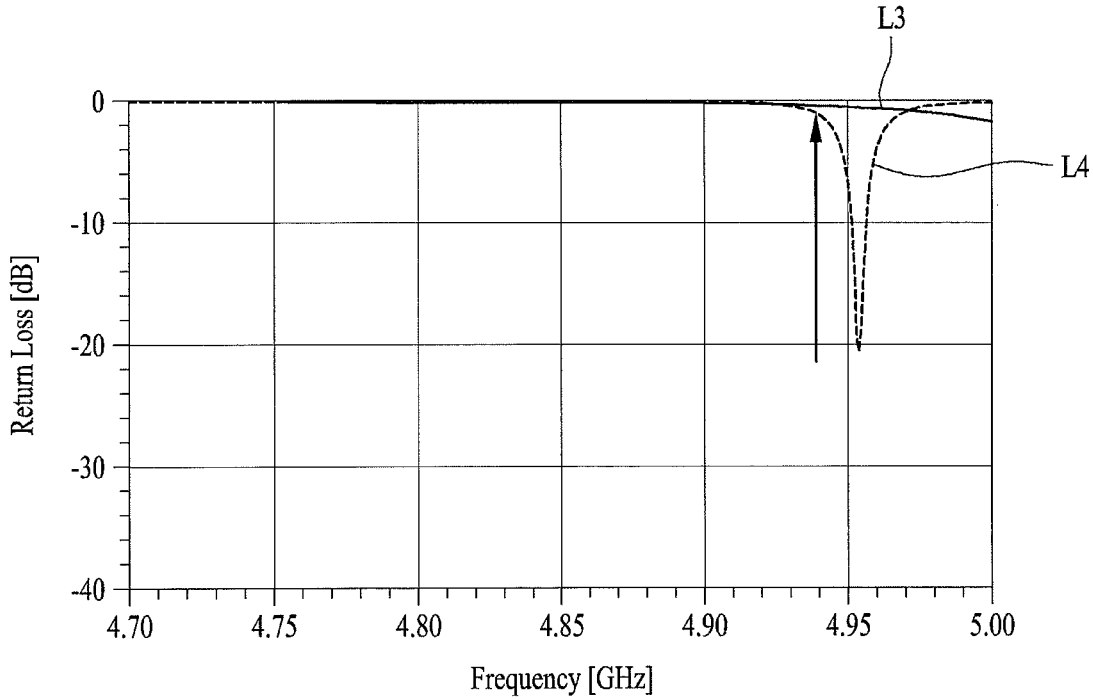

Next, FIGS. 6 and 7 are graphs showing effects of the lighting apparatus according to an embodiment of the present invention. In particular, FIG. 6 is a graph showing a frequency and a return loss when N is 1, and FIG. 7 is a graph showing a frequency and a return loss when N is 2. In this embodiment, a return loss closer to 0 dB means that corresponding harmonics have been cut off. In addition, curves L1 and L3 are acquired in the lighting apparatus 100 having the second wave guide space 121-2 according to an embodiment of the present invention while curves L2 and L4 are acquired in a lighting apparatus not having the second wave guide space 121-2. Referring to FIG. 7, when N is 2, even harmonics are cut off in the lighting apparatus 100 having the second wave guide space 121-2 according to an embodiment of the present invention.

Figure 8:
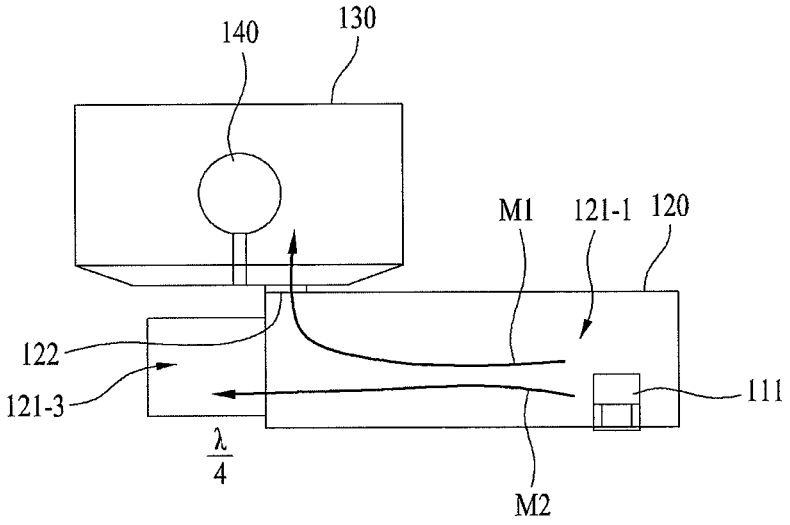
FIG. 8 is a conceptual view showing an operation mode of the lighting apparatus according to an embodiment of the present invention.

Next, FIG. 8 is a conceptual view showing an operation mode of the lighting apparatus according to an embodiment of the present invention. The embodiment of the lighting apparatus shown in FIG. 8 differs from the embodiment of the lighting apparatus shown in FIGS. 1-3 in that a second wave guide space 121-3 extends parallel to a longitudinal direction of the first wave guide space 121-1.

The odd harmonics M1 of the microwaves transmitted through the first wave guide space 121-1 are reflected from the second wave guide space 121-3 to the resonator 130. In addition, the even harmonics M2 of the microwaves transmitted through the first wave guide space 121-1 may be introduced into and grounded in the second wave guide space 121-3. That is, the second wave guide space 121-3 expanded parallel to a longitudinal direction of the first wave guide space 121-1 removes the above-described even harmonics M2.

In this embodiment, a cut-off frequency of the waveguide 120 is associated with a length of the wave guide space 121 and the second wave guide space 121-3 may be expanded from the first wave guide space 121-1 so as to have a length of 0.25 times a wavelength λ of the microwaves, thus serving to remove the even harmonics M2 of the microwaves.

A dielectric substance may also be inserted into the second wave guide space 121-3. In this instance, the second wave guide space 121-3 may extend by a length less than 0.25 times a wavelength λ of the microwaves.

Further, the first wave guide space 121-1 and the second wave guide space 121-3 may have the same length. That is, if the first wave guide space 121-1 has a length of λ/4, then the second wave guide space 121-3 may have a length of λ/4. In this embodiment, the second wave guide space 121-3 may extend from a distal end of the first wave guide space 121-1 by a length of λ/4.

A width of the second wave guide space 121-3 (corresponding to a height in FIG. 8) may be less than a longitudinal length of the second wave guide space 121-3. More specifically, if the second wave guide space 121-3 has a length of λ/4, a width (A) of the second wave guide space 121-3 may be less than λ/4.

Figure 9:
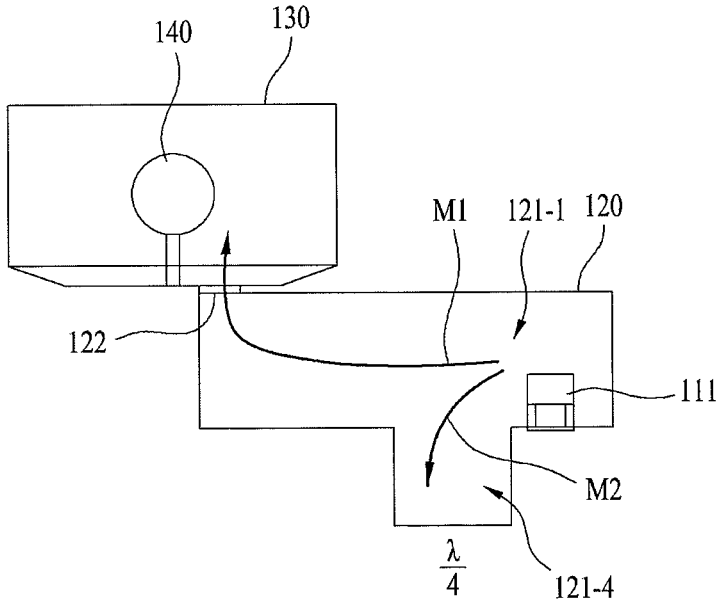
FIG. 9 is a conceptual view showing an operation mode of the lighting apparatus according to an embodiment of the present invention.

Next, FIG. 9 is a conceptual view showing an operation mode of the lighting apparatus according to an embodiment of the present invention. The embodiment of the lighting apparatus shown in FIG. 9 differs from the embodiment of the lighting apparatus shown in FIGS. 1-3 in that a second wave guide space 121-4 extends from a particular region of the first wave guide space 121-1 between the magnetron 110 and the bulb 140. In this embodiment, the second wave guide space 121-4 is expanded from a point at a distance that is less than λ/4 from an entrance of the first wave guide space 121-1.

Even in this embodiment, odd harmonics M1 of the microwaves transmitted through the first wave guide space 121-1 are reflected from the second wave guide space 121-4 to the resonator 130. In addition, the even harmonics M2 of the microwaves, transmitted through the first wave guide space 121-1 are introduced into and grounded in the second wave guide space 121-4.

In this embodiment, a cut-off frequency of the second wave guide space 121-4 is associated with a length of the wave guide space. The second wave guide space 121-4 is expanded from the first wave guide space 121-1 so as to have a length of 0.25 times a wavelength λ of the microwaves, thus serving to remove the even harmonics M2 of the microwaves.

A dielectric substance may also be inserted into the second wave guide space 121-4. In this instance, the second wave guide space 121-4 may extend by a length less than 0.25 times a wavelength λ of the microwaves.

Further, a width of the second wave guide space 121-4 may be less than a longitudinal length of the second wave guide space 121-4. More specifically, if the second wave guide space 121-4 has a length of λ/4, a width (A) of the second wave guide space 121-4 may be less than λ/4.

As is apparent from the above description, a lighting apparatus according to an embodiment of the present invention enhances luminous efficacy and increases magnetron lifespan. In addition, a lighting apparatus according to an embodiment of the present invention improves EMI.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A lighting apparatus comprising:

a magnetron configured to generate microwaves having a predetermined frequency;

a waveguide including a first wave guide space configured to introduce and guide the microwaves and a second wave guide space expanded from the first wave guide space;

a resonator to which the microwaves are transmitted from the waveguide; and a bulb located in the resonator, the bulb encapsulating a light emitting material and being configured to emit light in response to the transmitted microwaves, wherein the second wave guide space is located in a transmission path of the microwaves transmitted from the magnetron to the resonator, and wherein the second wave guide space is configured such that odd harmonics of the microwaves transmitted through the first wave guide space are reflected from the second wave guide space to the resonator and the even harmonics of the microwaves transmitted through the first wave guide space are introduced into and grounded in the second wave guide space.

2. The apparatus according to claim 1, wherein the second wave guide is configured to remove even harmonics of the microwaves transmitted along the first wave guide space.

3. The apparatus according to claim 1, wherein the second wave guide space is expanded from the first wave guide space so as to have a length of 0.25 times a wavelength of the microwaves.

4. The apparatus according to claim 1, wherein the first wave guide space and the second wave guide space have a same length.

5. The apparatus according to claim 1, wherein the first wave guide space and the second wave guide space are configured to have the same characteristic impedance.

6. The apparatus according to claim 1, wherein the first wave guide space extends in a longitudinal direction between the magnetron and the resonator, and wherein the second wave guide space extends perpendicular to the longitudinal direction of the first wave guide space.

7. The apparatus according to claim 6, wherein the second wave guide space extends away from the bulb.

8. The apparatus according to claim 6, wherein the second wave guide space extends from a region of the first wave guide space between the magnetron and the bulb.

9. The apparatus according to claim 6, wherein the first and second wave guide spaces are arranged such that the microwaves to be transmitted to the resonator through the first wave guide space pass through the second wave guide space and, thereafter, odd harmonics of the microwaves are transmitted to the resonator and even harmonics are removed by the second wave guide space.

10. The apparatus according to claim 1, wherein the first wave guide space extends in a longitudinal direction between the magnetron and the resonator, and wherein the second wave guide space extends parallel to the longitudinal direction of the first wave guide space.

11. The apparatus according to claim 1, wherein a width of the second wave guide space is less than a longitudinal length of the second wave guide space.

12. The apparatus according to claim 1, wherein a dielectric substance is inserted into the second wave guide space.

13. The apparatus according to claim 12, wherein the second wave guide space extends from the first wave guide space by a length less than 0.25 times a wavelength of the microwaves.

14. A lighting apparatus comprising:

a magnetron configured to generate microwaves having a predetermined frequency;

a waveguide including a first wave guide space configured to introduce and guide the microwaves and a second wave guide space expanded from the first wave guide space;

a resonator to which the microwaves are transmitted from the waveguide; and a bulb located in the resonator, the bulb encapsulating a light emitting material and being configured to emit light in response to the transmitted microwaves, wherein the second wave guide space is located in a transmission path of the microwaves transmitted from the magnetron to the resonator, wherein the first wave guide space extends in a longitudinal direction between the magnetron and the resonator, wherein the second wave guide space extends perpendicular to the longitudinal direction of the first wave guide space, and wherein the first and second wave guide spaces are arranged such that the microwaves to be transmitted to the resonator through the first wave guide space pass through the second wave guide space, and such that odd harmonics of the microwaves are transmitted to the resonator and even harmonics are removed by the second wave guide space.

* * * * *